United States Patent [19]

Amano et al.

[11] 4,121,966

[45] Oct. 24, 1978

[54] METHOD FOR PRODUCING FIBROUS SHEET

[75] Inventors: Masahiro Amano; Takashi Koike, both of Tokyo, Japan

[73] Assignee: Mitsubishi Paper Mills, Ltd., Tokyo, Japan

[21] Appl. No.: 765,752

[22] Filed: Feb. 4, 1977

Related U.S. Application Data

[63] Continuation of Ser. No. 640,211, Dec. 12, 1975, abandoned.

[30] Foreign Application Priority Data

Feb. 13, 1975 [JP] Japan ..... 50-18254

[51] Int. Cl.[2] ..... D21D 3/00

[52] U.S. Cl. ..... 162/164 R; 162/164 EP; 162/166; 162/168 R; 162/168 N; 162/169; 162/183

[58] Field of Search ..... 162/168 R, 168 N, 164 R, 162/164 EP, 183, 169, 181 R, 181 B, 175; 260/37 R, 37 N, 29.6 S, 29.6 NR, 29.6 PT, 29.7 S, 29.7 PT, 29.7 NR; 106/308 M

[56] References Cited

U.S. PATENT DOCUMENTS

| | | | |
|---|---|---|---|
| 2,301,998 | 11/1942 | Bernstein et al. | 162/169 |
| 2,899,353 | 8/1959 | Engel et al. | 162/169 |
| 2,971,879 | 2/1961 | Piersol | 162/169 |
| 3,223,580 | 12/1965 | Eckert et al. | 162/169 |
| 3,344,017 | 9/1967 | Lesniak | 162/183 |
| 3,776,812 | 12/1973 | Jongetjes | 162/169 |

FOREIGN PATENT DOCUMENTS

| | | | |
|---|---|---|---|
| 1,338,759 | 11/1973 | United Kingdom | 162/169 |

OTHER PUBLICATIONS

Hach's "Chem. Dict." (1969), p. 736.

*Primary Examiner*—Robert L. Lindsay, Jr.
*Assistant Examiner*—Peter Chin
*Attorney, Agent, or Firm*—Cushman, Darby & Cushman

[57] ABSTRACT

A fibrous sheet bonded with a latex flocculate is produced by adding zinc white powders to a carboxyl modified anionic latex, adjusting the pH to at least 7, adding thereto a water soluble cationic polymer to obtain a latex flocculate, adding thus obtained flocculate to a fiber slurry and subjecting the fiber slurry to a known wet paper making process.

8 Claims, No Drawings

METHOD FOR PRODUCING FIBROUS SHEET

This is a continuation, of application Ser. No. 640,211 filed Dec. 12, 1975, now abandoned.

BACKGROUND OF THE INVENTION

The present invention relates to a method for producing a fibrous sheet and more particularly it relates to so-called internal application of latex in production of a fibrous sheet by known wet paper making techniques or wet non-woven fabric making techniques which comprises previously flocculating a carboxyl-modified anionic latex, adding the resultant flocculate to a fiber slurry, making the slurry into a sheet and drying the sheet to obtain a fibrous sheet. The method for the internal application of latex can be roughly classified into the following two techniques.

(1) A method which comprises adding an anionic latex to a fiber slurry and flocculating the latex with a polyvalent metal salt to deposit the latex onto the fibers. This is called beater addition.

(a) Direct method: This method comprises said steps in the order as mentioned above.

(b) Reverse method (Armstrong method in another name): This method comprises adding a polyvalent metal salt to a fiber slurry to adsorb the salt onto the fibers and then adding an anionic latex thereto to flocculate and deposite the latex onto the fibers.

(c) Bardac Process: The order of addition is the same as that of said reverse method (b), but a melamine resin acid colloid is used in place of the polyvalent metal salt.

(2) A method which comprises previously flocculating a latex, dispersing the resultant flocculate in a fiber slurry and retaining the latex by filtering action in paper making process.

The present invention provides an improved method which belongs to the technical field of the above mentioned (2). The technique (1) has been developed for the purpose of production of special papers which uses pulps as a starting material, but this method has various defects. That is, this method can be relatively smoothly carried out in the case of adding a latex in an amount of less than 10% by weight of fibers, but when the latex is added in an amount of more than 15% by weight, the following disadvantages occur: Uniform flocculation and deposition of the latex onto fibers difficultly occur and bulk flocculates of more than 1 mm separated from fibers are present to result in troubles in paper making procedure. Furthermore, the resultant fibrous sheet which is merely filled with latex masses has low strength, has resin specks throughout the surface to lose the value as a product and lacks water resistance, high flexibility, and softness which are characteristics of a sheet to which latex is added. Furthermore, this method is not effective for production of non-woven fabrics mainly composed of regenerated fibers or synthetic fibers and substantially no strength is developed. The reasons therefor are considered to be as follows: The regenerated fibers and synthetic fibers have smaller surface area than beaten pulp and so amount of deposition of latex is very small. Furthermore, even if latex can be uniformly deposited onto the surface of fibers by some special means, being different from papers and boards which are mainly composed of beaten pulp and have a high density, non-woven fabrics which are mainly composed of regenerated fibers or synthetic fibers and which have a low density and must have a bulkiness contain extremely small number of bonding points of fibers and hence efficiency of latex is markedly decreased.

Intermediate techniques between the methods (1) and (2) are proposed in Japanese Pat. Publications Nos. 75/64 and 14272/65. According to these methods which attempt to remove the defects in the method (1), pre-flocculated particles of more than 1$\mu$ and less than 60–100$\mu$ are previously prepared, these particles are added to a fiber slurry adjusted to neutral and then pH of the slurry is adjusted to acidic to cause final flocculation of said pre-flocculated particles and deposition of the particles onto the fibers. However, coarse masses of more than 1 mm are formed when pH is reduced and free masses of latex are present to result in troubles in paper making and formation of specks of latex on the resultant fibrous sheet. Furthermore, tackiness of the fibrous sheet is increased and blocking is apt to occur at rewinding of the roll of the sheet to cause fluffing.

Examples of the method (2) which is based on the same idea as addition of fibrous binder or powdery binder to a fiber slurry are disclosed in Japanese Pat. Publication No. 20195/73 and U.S. Pat. No. 3,776,812.

Japanese Pat. Publication No. 20195/73 discloses that a latex liquid is thickened with carboxymethyl cellulose or polyacrylic ester and then the latex is flocculated with an aluminum salt to obtain flocculate of uniform size. However, according to this method, thickening agent is also flocculated and tackiness is lost at flocculation of latex. Thus, effect of the thickening agent to obtain uniform flocculated particles cannot be expected. Moreover, coarse masses of more than 1 mm are apt to be produced due to the shock of addition which is caused by intensity of electric charge of the aluminum ion and reduction in pH. Therefore, the troubles in paper making as in the method (1) tend to occur and moreover strength of the resultant web is not satisfactory. Such method is considered effective only when this is combined with a special coagulating apparatus. This method has the further defect that the wet strength of the resultant sheet is low because a large amount of aluminum salt is incorporated into the latex flocculate.

U.S. Pat. No. 3,776,812 proposes the method which comprises producing fine pre-flocculates of less than 50$\mu$ by mixing carboxyl modified latex with water soluble cationic polymer at a pH of 6–9 and adjusting the pH to 2–4 to obtain fibrous flocculate (particle size 100–500$\mu$). However, detailed examination of this method shows that even when the pH of the pre-flocculate is reduced to 2–4, the resultant flocculated particles have 50–100$\mu$ at largest. In this case, retention of the flocculate at paper making process is low and properties of the resultant sheet are also not satisfactory.

According to the experiments by the inventors, it has been found that it is essential that particle size of the flocculate should be adjusted to 100–500$\mu$, preferably 100–300$\mu$.

Particle size of the flocculate is defined as maximum diameter of each flocculate when observed under microscope.

As mentioned above, the method (2) has stil many defects, which are summarized as follows:

(a) Preparation of flocculate having uniform particle size is very difficult. That is, when too fine, the retention of the flocculate at paper making is decreased and when too coarse, bonding joints of the fibers are conspicuously decreased to cause reduction in strength and moreover specks are apt to occur on the surface of the resultant sheet.

(b) There occur many troubles on paper machine, for example, clogging of wire, stain of felt, sticking of the sheet to drier, etc.

(c) Tackiness of flocculated latex is great and the resultant sheet after drying step still has tackiness. Thus, the rolled fibrous sheets are liable to adhere to each other to result in fluffing at rewinding of the roll of the sheet.

(d) A special solidifying apparatus is necessary.

SUMMARY OF THE INVENTION

The inventors have investigated the reasons why flocculation of latex according to the conventional technique often results in coarse masses of more than 1 mm to find that this is because the flocculation abruptly occurs due to addition shock of flocculant and ununiform diffusion of the flocculant and the once formed fine particles collide with each other, during which they are coarsened due to tackiness. The inventors have made an attempt to accomplish smooth flocculation with very common apparatus comprising a diluting tank provided with a stirrer without using any special apparatus. As the result, they have succeeded in preparation of flocculated particles of latex which have preferred particle size (100–500μ) and have a low tackiness. Thus, the present invention have been accomplished.

That is, the present invention is a method for producing a fibrous sheet bonded with latex flocculate which comprises allowing zinc white powders to coexist in a carboxyl modified anionic latex in an amount of 1–10% by weight of latex solid matter, then adjusting the pH to not less than 7, thereafter adding a water soluble cationic polymer as a flocculant to coprecipitate said zinc white as a flocculating nucleus to obtain a flocculate of 100μ–500μ in particle size, then adding the flocculate to a fiber slurry separately prepared, forming the slurry into a sheet by a known wet paper making process and then drying the sheet.

DESCRIPTION OF THE PREFERRED EMBODIMENTS

The most important characteristic of the method of the present invention is that zinc white acts as nucleus for flocculation and the flocculation smoothly proceeds from surface of zinc white particles with addition of flocculant, thereby to prevent formation of flocculated masses caused by the shock of the addition of flocculant and to provide remarkable effect on uniformalization and thus flocculate having a particle size of 100μ–500μ which is optimum for paper making can be simply obtained.

Zinc white slightly dissolves in water and dissociates to release Zn ion. Therefore, the surface of zinc white particles has a high positive charge density and latex is easily flocculated. Thus, remarkable effect as mentioned hereinbefore can be exhibited. Furthermore, zinc white reacts with carboxyl group of latex to cause proper cross-linking. Therefore, tackiness of flocculate is controlled to some extent in water and the once formed flocculate of 100μ–500μ in particle size does not become coarse in storage and is stably present. Therefore, it does not substantially stick to wire or felt at paper making process and can be easily removed by water washing. Furthermore, the resultant sheet can be easily removed from surface of drier and moreover is not stained. Furthermore, the resultant fibrous sheet has water resistance, high flexibility, softness and high strength and has no tackiness.

The zinc white used here means zinc white powders which are generally used as a valcanizing accelerator for raw rubber, synthetic rubber, etc. and can be classified into dry zinc white and wet zinc white depending upon production method. Any of these zinc white can be similarly used in the present invention.

It is known that zinc white acts as a crosslinking agent for carboxyl modified latex and this is practically used as impregnating processing liquid for non-woven fabric. However, in such known application of zinc white, this is added merely as a crosslinking agent for latex and is not added for flocculation of the latex. Therefore, a stabilizer is added to the impregnating liquid to which zinc white is added to prevent flocculation of the latex.

Noticing the fact that zinc white is somewhat solubilized and ionized in water, the inventors have utilized the zinc white as a nucleating agent for flocculation by successfully employing the insolubilizing action of latex at interface between the zinc white powders and latex particles, whereby it has become possible to prepare uniform flocculated particles containing no coarse masses.

Regarding the amount of zinc white added, when it is less than 1% by weight of the latex solid matter, the effect of the addition is not exhibited and when it is more than 10% by weight, no additional effect can be obtained or rather strength tends to decrease. This is considered because adhesiveness of the flocculated particles decreases due to crosslinking at heating.

When the pH of the latex is less than 6, shock brought about by the addition of flocculant is too great and flocculate of latex cannot be controlled to the suitable particle size of 100μ–500μ even in the presence of zinc white and coarse masses are formed. Therefore, it is necessary to keep the pH at not less than 7. Furthermore, chemical stability often varies depending on the kind of the latex used and it is desired to determine previously an optimum pH by testing the relation between pH and size of the flocculate.

It is also a great advantage of this invention that no special coagulating apparatus is required.

The carboxyl modified anionic latex used herein generally means a reactive latex having carboxyl group on side chain of molecule which is obtained by copolymerizing unsaturated acid monomer, e.g., maleic acid, acrylic acid, methacrylic acid, etc. at the polymerization of latex.

The representatives thereof are carboxyl modified latex of a styrene-butadiene copolymer, an acrylonitrile.butadiene copolymer, a methylmethacrylate.-butadiene copolymer, a polyacrylate, a polyvinyl chloride, a polyvinyl acetate, a vinyl acetate.ethylene copolymer, a vinyl acetate.acrylate copolymer, a vinyl chloride.acrylate copolymer or mixtures thereof.

Particle size of these latices is generally less than 1–2μ.

Preferably the solid matter concentration of latex is diluted to 0.5–10% by weight prior to the flocculation and when the concentration is too high, too much impingement of the latex particles occurs and coarse masses are apt to occur.

The water soluble cationic polymers used herein are resins which exhibit cationic property in water. Especially useful resins are polyamide.polyamine.epichlorohydrin resins, polyethyleneimine resins, cationic modified melamine.formalin resins, and cationic modified urea.formalin resins. These are all used in the state of initial condensate and are also useful as a retention improving agent and a wet strengthening agent in paper making. Furthermore, cationic modified starch may also be used.

Amount of said water soluble cationic polymer varies depending upon the difference in stability of the latex, but a minimum amount necessary for completely flocculating the latex is sufficient. However, the amount should not exceed 1.5 times the minimum amount necessary for completely flocculating the latex. Said minimum amount can be easily determined by preliminary experiment.

The fibers used may be any fibers such as natural cellulose fibers, regenerated fibers, synthetic fibers, inorganic fibers, metallic fibers, collagen fibers, etc. or mixtures thereof.

If necessary, sizing agent, filler, paper strength increasing agent, retention improving agent, coloring agent, dispersion controlling agent, etc. may also be added. Therefore, the fiber slurry herein used may be an aqueous dispersion containing the additives as mentioned above beside fibers.

The present invention exhibits especially high effect when applied to the production of wet non-woven fabrics, but it may also be applied to the production of the conventional paper or board and suitable for production of imitation leather paper, wall paper, etc.

The percent by weight and part used herein are all in terms of solid matter unless otherwise specified.

The present invention will be illustrated in the following Examples.

EXAMPLE 1

To 500l of 3% by weight diluted liquid of Nipol 2570 × 5 (Latex of a carboxyl modified styrene-butadiene copolymer produced by Nihon Zeon K. K.) was added, while stirring in such a manner that no bubling occurred, 0.8 kg of Zinca #20 (wet zinc white produced by Sakai Kagaku K. K.) to result in homogeneous dispersion and then pH of the dispersion was adjusted to 9.0.

To said dispersion was added 92 kg of 2% by weight aqueous solution of Polyfix 201 (a polyamide.-polyamine.epichlorohydrin cationic resin produced by Syowa Kobunshi K. K.) to obtain a flocculate having a particle size of 100μ–300μ. This dispersion was stable even when allowed to stand for several ten hours under stirring.

Said flocculate was added in a predetermined amount to the various fiber slurries separately prepared and fibrous sheets were produced therefrom by the known wet paper making process. They had the properties as shown in Table 1—1. That is, they had softness, an extremely high folding endurance and a great elongation. Furthermore, these fibrous sheets had no resin specks and had no tackiness. Of course, there occurred no troubles in paper making procedure.

Table 1-1

| | Pulp 100 % paper | | Non-woven fabric | | Synthetic pulp paper | |
|---|---|---|---|---|---|---|
| Blending of fiber | NBKP 100 parts | | NBKP 20 parts Rayon[1] 80 parts | | Synthetic pulp[2] 100 parts | |
| Latex flocculate | 20 parts | 100 parts | 20 parts | 30 parts | 20 parts | 100 parts |
| Basis weight (g/m²) | 203 | 200 | 47.6 | 49.2 | 187 | 181 |
| Tensile[3] Dry strength | 4.2 | 7.5 | 1.4 | 1.7 | 1.5 | 1.8 |
| (kg/15 mm) Wet | 0.9 | 3.4 | 0.6 | 0.9 | 0.6 | 1.2 |
| Elongation[3] Dry | 10 | 24 | 15 | 15 | 81 | 104 |
| (%) Wet | 12 | 23 | 30 | 26 | 41 | 61 |
| MIT folding[4] endurance (the number of times) | 9200 | 15000 | 1000 | 3000 | 4000 | 7000 |
| Cantilever bending resistance[5] (mm) | 180 | 132 | 68 | 79 | 112 | 80 |

Note:
[1]"Rayon": 1.5 denier, 10 mm length and produced by Mitsubishi Rayon K.K.
[2]"Synthetic pulp": Trade name "SWP" produced by Mitsui Zellerbach K.K.
[3]"Tensile strength" and "Elongation" (at breaking): TENSILON (TOYO MEASURING INSTRUMENTS CO., LTD.; Length of test piece ... 10 cm; Speed ... 50 mm/min.
[4]"MIT folding endurance": In accordance with Tappi Standard T-511-Su-69, Load... 1 kg.
[5]"Cantilever bending resistance": In accordance with JIS L-1079A.

For comparison, latex was flocculated and fibrous sheets were produced therefrom in the same manner as employed above except that no zinc white was added. Properties of the resultant sheets are shown in the following Table 1–2.

In this case, size of the flocculated particles of the latex was ununiform and there coexisted many coarse masses of more than 1 mm to extremely stain wires, wet felt and drier.

Moreover, there were many resin specks in the resultant sheets and the surface of the sheets had tackiness. Physical strengths of the sheets were also low and they could not be practically used.

Table 1-2

| | Pulp 100 % paper | Non-woven fabric | Synthetic pulp paper |
|---|---|---|---|
| Blending of fibers | NBKP 100 parts | NBKP 20 parts Rayon 80 parts | synthetic pulp 100 parts |
| Latex flocculate | 100 parts | 30 parts | 100 parts |
| Basis weight (g/m²) | 205 | 50.3 | 183 |
| Tensile strength Dry | 5.1 | 1.1 | 1.2 |
| (kg/15 mm) Wet | 1.7 | 0.4 | 0.7 |
| Elongation Dry | 16 | 11 | 70 |
| (%) Wet | 13 | 15 | 43 |
| MIT folding endurance (times) | 10000 | 250 | 1500 |
| Cantilever bending | | | |

Table 1-2-continued

| | Pulp 100 % paper | Non-woven fabric | Synthetic pulp paper |
|---|---|---|---|
| Blending of fibers | NBKP 100 parts | NBKP 20 parts<br>Rayon 80 parts | synthetic pulp 100 parts |
| Latex flocculate | 100 parts | 30 parts | 100 parts |
| resistance (mm) | 140 | 70 | 82 |

EXAMPLE 2

To 500l of 1% by weight diluted solution of Sumika Flex CY-36 (latex of a carboxyl modified vinylacetate-.ethylene copolymer produced by Sumitomo Chemical Co., Ltd.) while stirring in such a manner that no bubbling occurred was added 0.25 kg of zinc white No. 1 (dry zinc white produced by Sakai Kagaku K. K.) to obtain a dispersion. Then, pH of the dispersion was adjusted to 9.5 with sodium hydroxide. To this dispersion was added 3.5 kg of 5% by weight aqueous solution of Sumirez resin 607 (melamine.formalin cationic resin manufactured by Sumitomo Chemical Co., Ltd.) to obtain a dispersion of flocculate having a particle size of 200μ–500μ. This flocculate did not change and was stable even when allowed to stand for several ten hours under stirring.

Said flocculate was added to various fiber slurries which were separately prepared and fibrous sheets were produced therefrom in the same manner as in Example 1. Properties of these sheets are shown in Table 2. That is, they had excellent strength and had no tackiness and resin specks. Of course, there occurred no troubles in paper making procedure.

Table 2

| | | Rayon[1] paper | Polypropylene fiber paper[2] | Glass fiber paper[3] |
|---|---|---|---|---|
| Bending ratio | Fibers | 100 parts | 100 parts | 100 parts |
| | Latex flocculate | 30 parts | 40 parts | 20 parts |
| Basis weight (g/m²) | | 50.3 | 48.5 | 100 |
| Tensile strength (kg/15 mm) | Dry | 1.6 | 1.3 | 0.8 |
| | Wet | 0.85 | 0.5 | — |
| Elongation (%) | Dry | 16 | 18 | 40 |
| | Wet | 26 | 22 | — |
| MIT folding endurance (The number of times) | | 2500 | 500 | — |
| Cantilever bending resistance (mm) | | 83 | 40 | — |

Note:
[1]"Rayon": 1.5 denier, 10 mm length and produced by Mitsubishi Rayon K.K.
[2]"Polypropylene fibers": 2 deniers, 7 mm length and produced by Mitsubishi Rayon K.K.
[3]"Glass fibers": Trade name MLF-A, produced by Japan Glass Fiber K.K.

EXAMPLE 3

To 500l of 5% by weight diluted solution of Nipol LX811 (latex of a carboxyl modified acrylate polymer produced by Nihon Zeon K. K.) while stirring in such a manner that no bubbling occurred was added 1.5 kg of Zinca #20 and then pH was adjusted to 8. Then, 62.5 kg of 1.25% by weight aqueous solution of Polymin SN (a polyethylene-imine produced by BASF Dyes & Chemicals, LTD) was added to obtain a dispersion of uniform flocculated particles having a particle size of 100μ–400μ, which was stable even when allowed to stand for several ten hours under stirring.

This was added to fiber slurries separately prepared and fibrous sheets were produced therefrom by wet paper making process. These fibrous sheets had the properties as shown in Table 3, namely, were soft and had a great elongation and extremely high folding endurance. Furthermore, there occurred no troubles in the paper making procedure.

Table 3

| | | |
|---|---|---|
| Blending of fibers | | NBKP 20 parts<br>Rayon 80 parts |
| Latex flocculate | | 30 parts |
| Basis weight (g/m²) | | 53.4 |
| Tensile strength (kg/15 mm) | Dry | 2.3 |
| | Wet | 1.2 |
| Elongation (%) | Dry | 15.3 |
| | Wet | 29.7 |
| MIT folding endurance (The number of times) | | 6000 |
| Cantilever bending resistance (mm) | | 97 |

EXAMPLE 4

In the same manner as in Example 3, to the Nipol LX811 was added Zinca #20. Then, the pH was adjusted to 7.3. Thereafter, 87.5 kg of 1% by weight aqueous solution of CATO 102 (cationic starch produced by National Starch and Chemical Corporation) in place of Polymin SN was added to obtain a homogeneous dispersion of flocculated particles having a particle size of 100μ–300μ, which was stable as in Example 3.

The fibrous sheets obtained in the same manner as in Example 3 were nearly the same as in Example 3 and very excellent.

Furthermore, there occurred no troubles in the paper making procedure.

EXAMPLE 5

To 500l of 1% by weight diluted solution of Polylac ML-520 (latex of a carboxyl modified methylmethacrylate.butadiene copolymer produced by Mitsui Toatsu K. K.) was added 0.4 kg of Zinca #20 to obtain a dispersion. Then, pH was adjusted to 8.5.

To said dispersion was added 37.5 kg of 1% by weight aqueous solution of Epinox P-1301 (polyamide.-polyamine.epichlorohydrin cationic resin produced by Dick Hercules Co.) to obtain a dispersion of flocculates having a particle size of 100μ–500μ.

Said dispersion was stable even when allowed to stand under stirring for several ten hours.

Fibrous sheet was produced therefrom in the same fiber blending ratio and amount of latex as in Example 3. The sheet had a basis weight of 50 g/m², a tensile strength of 2.1 kg/15 mm, an elongation of 16%, a MIT folding endurance of 5500 times and a cantilever bending resistance of 95 mm.

EXAMPLE 6

500l of a mixed diluted solution (solid matter concentration 1% by weight) of Nipol 2570 × 5 and Nipol LX811 in a solid matter ratio of 1:1 was prepared. 0.45 kg of Zinc white No. 1 was added to said mixed solution while stirring so that no bubbling occured to result in homogeneous dispersion. Then, pH was adjusted to 8.5. Thereafter, 32 kg of 2% by weight aqueous solution of Polyfix 201 to obtain flocculates having a particle size of 100μ–400μ. This was stable even when allowed to stand for several ten hours under stirring.

The flocculate was added to a fiber slurry having the fiber blending ratio as shown in Table 4 in an amount of 20% (in solid matter ratio) per weight of fiber and then a dried sheet was produced therefrom by wet paper making process. The sheet had the properties as shown in Table 4. That is, it was very soft and had an elongation and an extremely high folding endurance.

Of course, no troubles occurred in the paper making procedure.

Table 4

| | | | |
|---|---|---|---|
| | Fibers | Rayon (1.5 denier, 7 mm length) | 40 parts |
| | | Polypropylene fibers (2 deniers, 7 mm length) | 20 parts |
| | | Polyamide fibers (7 deniers, 29 mm length) | 10 parts |
| | | NBKP (un-beaten) | 30 parts |
| Blending ratio | Latex flocculate | | 20 parts |

| | | |
|---|---|---|
| Basis weight (g/m²) | | 50.1 |
| Tensile strength (kg/15 mm) | Dry | 2.1 |
| | Wet | 1.0 |
| Elongation (%) | Dry | 18 |
| | Wet | 32 |
| MIT folding endurance (the number of time) | | 3000 |
| Cantilever bending resistance (mm) | | 61 |

What is claimed is:

1. A method for producing a fibrous sheet which consists of adding zinc white to a carboxyl modified anionic latex to disperse the zinc white in the latex, adjusting pH of the dispersion to at least 7, adding a water soluble cationic polymer to the dispersion at said pH while stirring to produce a latex flocculate having a particle size of 100μ–500μ, adding said latex flocculate to a fiber slurry, producing a sheet therefrom by wet paper making process and drying the resultant sheet.

2. A method according to claim 1, wherein the amount of zinc white is 1–10% by weight of solid matter of the carboxyl modified anionic latex.

3. A method according to claim 1, wherein the carboxyl modified anionic latex is the latex of a carboxyl modified styrene.butadiene copolymer, a acrylonitrile.-butadiene copolymer, a methylmethacrylate.butadiene copolymer, a polyacrylate, a polyvinyl chloride, a polyvinyl acetate, a vinylacetate.ethylene copolymer, a vinyl acetate.acrylate copolymer, a vinyl chloride.acrylate ester copolymer or a mixture thereof.

4. A method according to claim 1, wherein the water soluble cationic polymer is polyamide.polyamine.epichlorohydrin resin, polyethyleneimine resin, cationic modified melamine.formaldehyde resin, cationic modified urea.formaldehyde resin or cationic modified starch.

5. A method according to claim 1, wherein the latex has a solid matter concentration of 0.5–10% by weight.

6. A method according to claim 1, wherein amount of the water soluble cationic polymer is less than 1.5 times the minimum amount required for complete flocculation of the latex.

7. A method according to claim 1, wherein the fibers are natural fibers, regenerated fibers, synthetic fibers, inorganic fibers, metallic fibers, collagen fibers or mixtures thereof.

8. A method according to claim 1 wherein the particle size of the latex flocculate is 100–300.

* * * * *